United States Patent [19]

Simizu et al.

[11] Patent Number: 4,940,542

[45] Date of Patent: Jul. 10, 1990

[54] LIQUID PURIFYING DEVICE

[75] Inventors: Kazuo Simizu, Nagoya; Shin Sakai, Aichi; Satoru Matsumoto, Nagoya; Osamu Yamamoto, Ichikawa; Hisao Tanaka, Nagoya, all of Japan

[73] Assignees: Tomei Sangyo Kabushiki Kaisha, Nagoya; Mitsubishi Rayon Co., Ltd., Tokyo, both of Japan

[21] Appl. No.: 428,004

[22] Filed: Oct. 27, 1989

Related U.S. Application Data

[63] Continuation of Ser. No. 340,037, Apr. 18, 1989, abandoned.

[30] Foreign Application Priority Data

Apr. 21, 1988 [JP] Japan ..... 63-98924
Mar. 31, 1989 [JP] Japan ..... 64-183003

[51] Int. Cl.[5] ..... E01D 61/00

[52] U.S. Cl. ..... 210/321.8; 210/321.89; 210/500.23

[58] Field of Search ..... 239/337–341, 239/344, 347, 348, 354, 372, 373; 128/200.14, 220.21, 200.22, 200.23; 210/500.23, 500.78, 500.79, 500.8, 500.87, 500.88, 500.89, 321.6, 321.78, 321.8, 321.79, 321.87, 321.88, 321.89

[56] References Cited

U.S. PATENT DOCUMENTS 2,681,252 6/1954 Tuttle .
3,986,510 10/1976 Higuchi et al. ..... 424/428
4,076,656 2/1978 White et al. ..... 521/64
4,595,121 6/1986 Schultz .
4,613,377 9/1986 Yamazaki et al. ..... 127/39

FOREIGN PATENT DOCUMENTS 367324 6/1906 France .
62-90706 6/1987 Japan .
62-125804 6/1987 Japan .
815610 7/1959 United Kingdom .
8801981 3/1988 World Int. Prop. O. .

*Primary Examiner*—Frank Sever
*Attorney, Agent, or Firm*—Oliff & Berridge

[57] ABSTRACT

A device for dispensing a liquid, including a container having an interior space accommodating the liquid, a first valve attached to the container, a delivery path having one end submerged in the liquid and extending through the container such that the other end is outside the container, and a second valve disposed in the delivery path for closing and opening the delivery path. The first valve permits a pressurized gas to flow therethrough into the container to raise the pressure within the container, but inhibits a discharge flow of the pressurized gas and the liquid therethrough out of the interior space. The liquid is delivered out of the container through the delivery path, due to the raised pressure within the interior space. The device has a micro-porous membrane filter disposed in a portion of the delivery path which is located upstream of the second valve, as viewed in the direction of delivery of the liquid. The micro-porous membrane filter removes microorganisms from the liquid delivered from the delivery path.

16 Claims, 15 Drawing Sheets

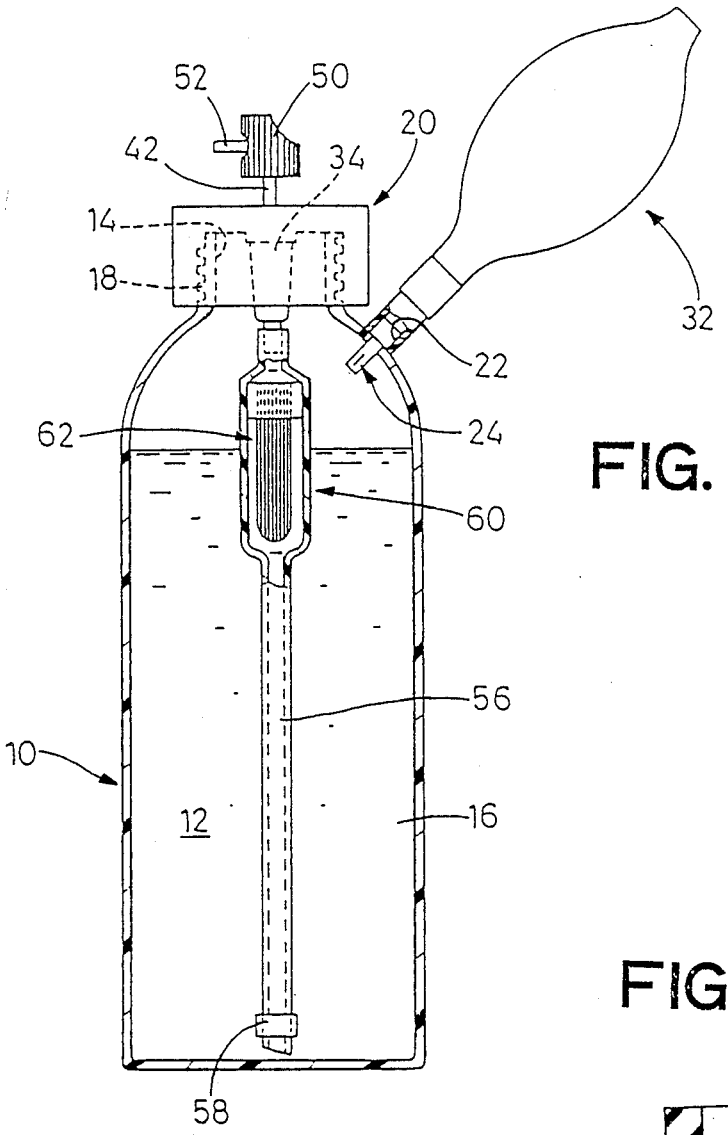
FIG. 1
FIG. 2
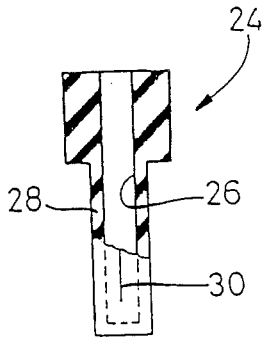

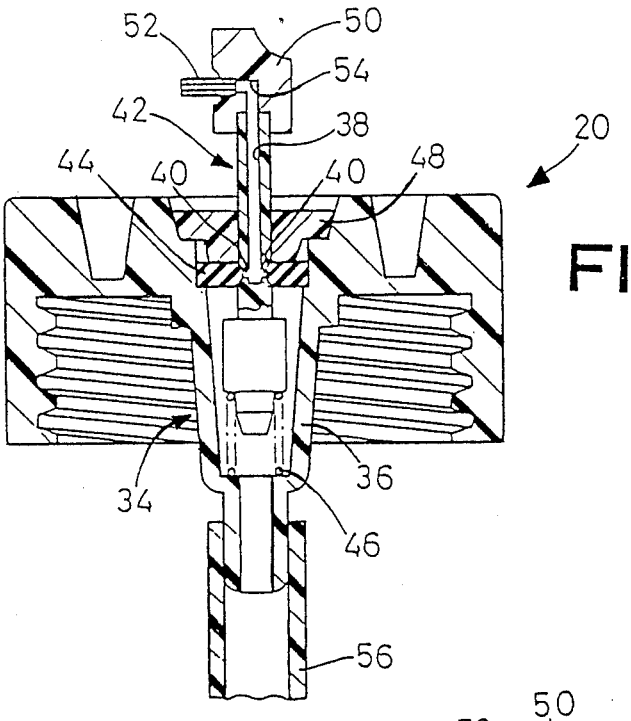
FIG. 3
FIG. 4
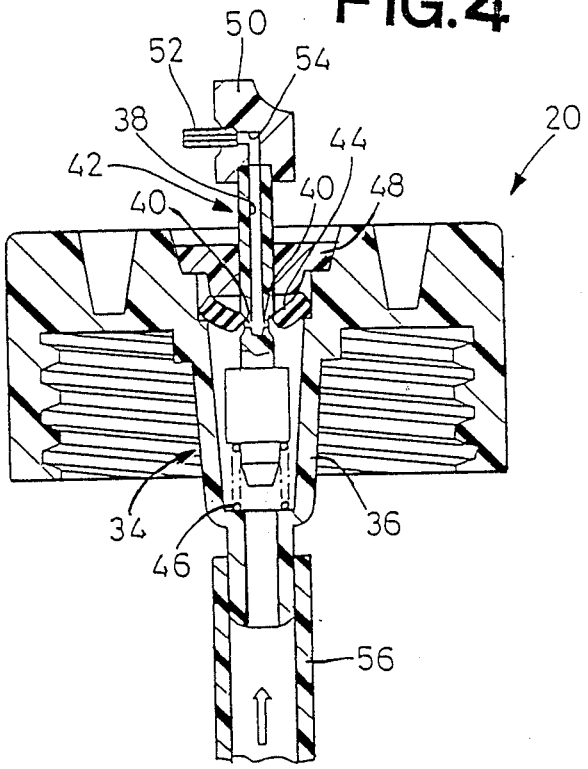

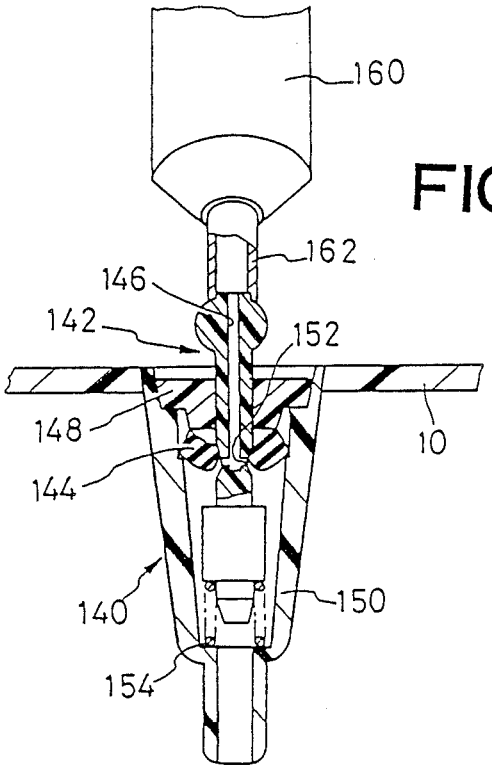
FIG.21
FIG.22
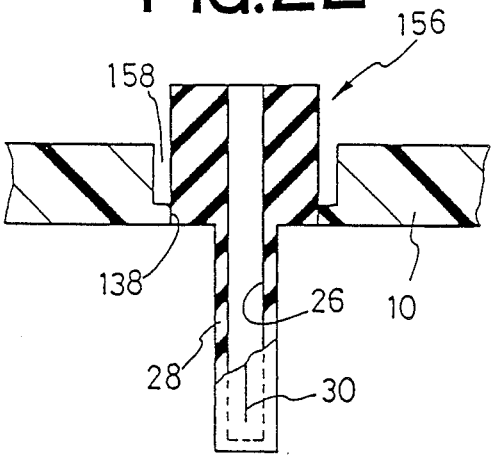

LIQUID PURIFYING DEVICE

This is a continuation of application Ser. No. 07/340,037 filed Apr. 18, 1989 (now abandoned).

BACKGROUND OF THE INVENTION

1. Field of the Invention

The present invention relates to a device which permits easy delivery of a sterile water or pharmaceutical liquid used in the fields of medical treatment, health and hygienics or sanitation, biochemistry, bacteriology, or in the fields associated with foods and drinks and cosmetics. More particularly, the present invention is concerned with improvements in a liquid purifying device which is suitable for delivering or dispensing a sterile liquid, through an outlet of a container communicating with the ambient atmsophere, while preventing contamination by microorganisms passing into the container through the outlet.

2. Discussion of the Prior Art

Various aqueous solutions, pharmaceutical liquids or liquid drugs are used in the fields of medical treatment, health and hygienics, biochemistry and bacteriology, for example. Examples of such liquids include pharmaceutical liquids used in medical institutions such as hospitals, and soaking or cleaning solutions for contact lenses. The liquids are generally purchased as accommodated in comparatively large containers, and are dispensed in desired amounts when needed, for a relatively long period. The containers have dispenser outlets through which the liquids are delivered. This arrangement for dispensation of the liquids suffers from contamination of the liquids by bacteria or microorganisms which may come into the containers through the liquid delivery outlet.

In view of the above drawback, the assignee of the present application proposed liquid purifying devices as disclosed in laid-open Publication Nos. 62-125804 and 62-90706 of unexamined Japanese Patent Application and unexamined Japanese Utility Model Application, respectively. These devices use a container for accommodating a liquid, and a micro-porous membrane disposed in a liquid delivery path. The container is formed of a suitable elastic material so that the container body is elastically contracted, by squeezing hand pressure, to deliver the liquid, and is elastically restored to its original shape upon releasing of the hand pressure. The micro-porous membrane permits the liquid to flow therethrough but inhibits passage of bacteria therethrough. In this device, the bacteria contained in the liquid are removed by the micro-porous membrane provided in the liquid delivery path, when the liquid is delivered or dispensed from the container. Accordingly, even the liquid which is contaminated by microorganisms within the container may be purified so that the liquid as dispensed may be made sterile.

In the proposed liquid purifying devices, however, the liquid delivery path or passage for delivering the liquid from the container is held exposed to the ambient atmosphere. Therefore, the interior of the liquid delivery passage, and the micro-porous membrane filter disposed therein may be contaminated by microorganisms introduced through the exposed end of the passage. The microorganisms may easily enter the liquid delivery passage, together with a flow of the ambient air into the interior of the container through the liquid delivery passage, due to a comparatively reduced pressure within the container, which is developed when the contracted container is elastically restored to its original shape. Consequently, a portion of the liquid mass which has been purified by the porous film filter but has not been delivered may be contaminated by the microorganisms contained in the air which is sucked into the liquid delivery passage. Thus, the proposed liquid purifying device is not satisfactory in its capability of removing microorganisms, and has some room for improvements.

SUMMARY OF THE INVENTION

The present invention was made in view of the prior art situations described above. It is accordingly an object of the present invention to provide a liquid purifying device for dispensing a sterile liquid, which is simple and compact in construction, and which is suitably protected against contamination by microorganisms through a liquid delivery passage exposed to the atmosphere, thereby providing improved liquid purifying capability.

The above object may be accomplished according to the principle of the present invention, which provides a liquid purifying device for dispensing a liquid, comprising: (a) a container having an enclosed interior space in which a mass of the liquid is stored; (b) first valve means, attached to the container, for permitting a supply flow of a pressurized gas therethrough into the interior space of the container to raise a pressure within the interior space, and for inhibiting a discharge flow of the pressurized gas and the liquid therethrough out of the interior space; (c) a liquid delivery path having one end submerged in the mass of the liquid and extending through the container such that the other end is disposed outside the interior space, the liquid being delivered out of the interior space through the liquid delivery path, due to the pressure within the interior space which is raised by the pressurized gas; (d) second valve means, disposed in the liquid delivery path, for selectively closing and opening the liquid delivery path; and (e) a micro-porous membrane disposed in a portion of the liquid delivery path which is upstream of the second valve means, as viewed in a direction in which the liquid is delivered out of the interior space. The micro-porous membrane filters the liquid to remove microorganisms from the liquid delivered through the other end of the liquid delivery path.

In the liquid purifying device of the present invention constructed as described above, the liquid delivery path is held closed by the second valve means provided therein, except when the liquid is purified and delivered. In this closed condition, the liquid delivery path is protected against contamination by microorganisms, the pressure within the interior space of the container is kept higher than the atmospheric pressure, even while the liquid delivery path is open with the second valve means placed in its open position to permit the purified liquid to be delivered out of the container. In this condition, the liquid in the delivery path or the ambient air is prevented from flowing back through the delivery path in the direction toward the interior space of the container. Thus, the interior of the delivery path and the micro-porous membrane disposed in the delivery path are completely protected against contamination by microorganisms. Accordingly, the instant liquid purifying device is capable of dispensing the liquid in a sterile condition, for a prolonged period of time, with high liquid purifying stability.

The interior space of the container of the purifying device of the invention is adapted to receive a pressurized gas such as a compressed or liquefied gas, so that the pressure within the interior space is kept higher than the atmospheric pressure. This arrangement permits the liquid to be filtered by the micro-porous membrane under a higher pressure than in the conventional device wherein the elastic container is contracted to raise the pressure within the container. Accordingly, the instant device assures a higher degree of efficiency of filtration of the liquid by the micro-porous membrane, namely, a larger amount of flow of the liquid through the micro-porous membrane per unit area of the membrane. Therefore, the porous filter may be made compact, whereby the purifying device may be made compact and small-sized.

According to the instant purifying device, the liquid may be replenished as needed, or the container may be re-charged with the liquid when necessary. Thus, the device may be used practically permanently, and is therefore economical to use.

In one form of the present invention, the purifying device further comprises pressurized-gas supply means for supplying one of a compressed gas and a liquefied gas, as the pressurized gas, into the interior space of the container through the first valve means. The pressurized-gas supply means may be located outside the container, or alternatively disposed within a structure of the container, such that the pressurized-gas supply means communicates with the interior space through the first valve means. An air filter may be provided in a passage between the pressurized-gas supply means and the interior space of the container, for filtering the pressurized gas to remove microorganisms from the pressurized gas which is supplied into the interior space.

In another form of the invention, the second valve means includes a valve stem, a valve seat and biasing means for normally holding the valve stem in a closed position. The valve stem has a passage which constitutes a part of the liquid delivery path. The passage is closed by the valve seat when the valve stem is placed in the closed position. The valve stem is axially movable against a biasing action of the biasing means, from the closed position to an open position in which the passage is open to permit the liquid to be delivered through the liquid delivery path. This type of valve is generally used in a spray can which is charged with a pressurized fluid. In this case, the liquid may be readily dispensed from the container, by operating the valve stem to the open position, for example, by finger pressure.

The pressurized gas used according to the invention may be a compressed gas such as compressed ambient air, helium, argon, nitrogen, oxygen or carbon dioxide, or a mixture thereof. Alternatively, the pressurized gas may be a liquefied gas such as liquefied chlorofluorinated hydrocarbon, chlorinated hydrocarbon or hydrocarbon, or a mixture thereof. Among these gases, ambient air is advantageous for its easy handling, low cost and harmlessness.

In a still further form of the invention, the porous filter comprises an array of micro-porous hollow fibers, each of which has a micro-porous wall structure having a pore size determined so as to permit passage of the liquid therethrough but inhibit passage of the microorganisms therethrough. The micro-porous hollow fibers may preferably be formed of polyolefin. The liquid delivery path may include a chamber in which the array of micro-porous hollow fibers is accommodated. In this case, the chamber has a header secured thereto so as to divide the chamber into two parts, and the array of micro-porous hollow fibers is U-shaped such that the U-shaped hollow fibers are held at opposite end portions thereof by the header such that the remaining portions of the hollow fibers are disposed in one of the two parts which is nearer to the end of the liquid delivery path submerged in the liquid mass.

BRIEF DESCRIPTION OF THE DRAWINGS

The foregoing and optional objects, features and advantages of the present invention will be better understood by reading the following detailed description of presently preferred embodiments of the invention, when considered in connection with the accompanying drawings, in which:

FIG. 1 is a schematic elevational view in longitudinal cross section of a liquid purifying device constructed according to one embodiment of the invention;

FIG. 2 is a partly cut-away elevational view in cross section of first valve means in the form of a suction check valve used in the liquid purifying device of FIG. 1;

FIGS. 3 and 4 are elevational views in cross section showing a construction of second valve means in the form of a dispenser valve incoporated in a container cap used in the device of FIG. 1, the figures indicating a closed and an open position of the valve, respectively;

FIGS. 15 and 21 are schematic elevational views of first valve means in the form of a suction check valve, FIG. 15 indicating a closed position of the valve, FIG. 21 indicating an open position of the valve in communication with a bomb which is filled with a compressed gas or liquefied gas;

FIG. 22 is a schematic cross sectional view showing a modified form of first valve means used in the liquid purifying device of the invention.

DETAILED DESCRIPTION OF PREFERRED EMBODIMENTS

Figure 5:
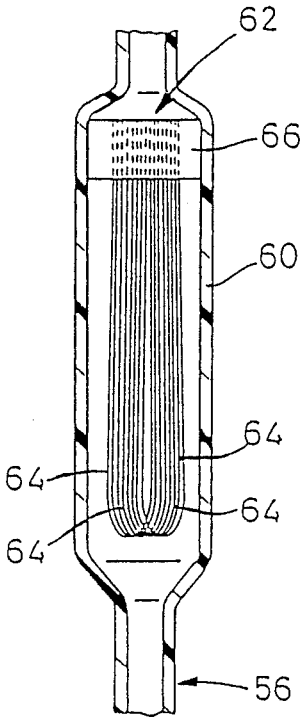
FIG. 5 is a fragmentary schematic elevational view in cross section of the device, illustrating a micro-porous hollow fiber module used in the device.

Referring first to FIG. 1, reference numeral 10 denotes a container in the form of a bottle having an interior storage space 12, and an opening 14 at its upper end communicating with the space 12. The container 10 accommodates a mass of a desired liquid 16, which is introduced through the opening or upper open end 14. The container 10 is formed of a soft or hard resin, a glass, a ceramic material, or any other suitable material conventionally used for containers, which does not affect the liquid 16 stored in the container or which is not affected by the liquid 16.

The opening 14 of the container 10 is formed through a cylindrical bottleneck 18 at its upper end, which is externally threaded, for engagement with an internally threaded cap 20, so that the opening or upper end 14 of the container 10 is gas- or fluid-tightly closed by the cap 20, for providing the fluid-tight enclosed storage space 12.

The container 10 has a gas inlet 22 formed through a shoulder portion thereof, so that the interior storage space 12 communicates with the outside of the container. The container 10 is provided with first valve means in the form of a suction check valve 24 fitted in the gas inlet 22. As illustrated in FIG. 2, the check valve 24 is a generally cylindrical member having a blind hole 26 which is open at one end thereof and closed at the other end. The check valve 24 has a slit 30 formed through a cylindrical wall 28 which defines the blind hole 26. In operation, the cylindrical wall 28 is elastically deformed due to a difference between an internal pressure in the blind hole 26 and an external pressure outside the cylindrical wall 28, whereby a fluid may flow from the blind hole 26 into the interior space 12 of the container 10. However, the check valve 24 does not permit the gas in the container 10 to pass out of the container 10 through the blind hole 26. In this sense, the check valve 24 is referred to as a "suction check valve" of a slit type, wherein only the flow of the fluid into the container interior space 12 of the container 10 through the slit 30 is permitted. Namely, the suction check valve 24 permits a pressurized fluid (e.g., compressed or liquefied gas) to be introduced into the interior space 12 through the gas inlet 22, while inhibiting a discharge flow of the fluid from the space 12 through the gas inlet 22 (i.e., through the slit 30).

To the suction check valve 24 fitted in the gas inlet 22 of the container 10, there is connected an open end of an air pump in the form of a conventionally available rubber bulb 32, which is alternately contracted and expanded so as to suck in the ambient air and feed the sucked air through its open end connected to the check valve 24. Thus, the operation of the rubber bulb 32 causes the compressed or pressurized air to flow into the interior storage space 12 of the container 10, through the gas inlet 22, i.e., through the check valve 24, whereby the pressure of the air in the storage space 12 accommodating the liquid 16 is raised. It will be understood that the rubber bulb or air pump 32 functions as means for supplying a pressurized air into the interior storage space 12 of the container, in the present embodiment.

In the meantime, the cap 20 is provided with second valve means in the form of a dispenser valve 34 of a push-operated type. This dispenser valve 34 is a known one commonly used as a valve for spraying minute liquid particles from a bomb. A typical arrangement of the dispenser valve 34 is illustrated in FIG. 3, wherein the cap 20 has an integrally formed valve housing 36 whose interior communicates with the interior space 12 of the container 10. The dispenser valve 34 includes a valve body in the form of a stem 42 which has an axial passage 38 formed in the longitudinal direction and radial holes 40 communicating with the axial passage 38. The axial passage 38 is open to the atmosphere. The valve housing 36 is provided with an elastic valve seat 44 and a retainer 48 secured thereto. The stem 42 of the dispenser valve 34 slidably engages the elastic valve seat 44 and the retainer 48, so that the stem 42 is longitudinally movable over a predetermined distance. The stem 42 is biased by biasing means in the form of a coil spring 46 in the longitudinal direction from the spring 46 toward the retainer 48, so that the stem 42 is normally placed in its closed position of FIG. 3. In this closed position, the radial holes 40 are closed by the valve seat 44, and the biasing force of the coil spring 46 is received by the retainer 48 via the stem 42 and the valve seat 44.

In FIG. 3, reference numeral 50 designates an operating head fixedly fitted on the upper end portion of the stem 42. This head 50 is finger-operated to place the dispenser valve 34 in its open position of FIG. 4. The operating head 50 has an L-shaped passage 54 formed therethrough, for fluid communication of the axial passage formed through the stem 42, with a nozzle 52 which is secured to the head 50 such that the free open end of the nozzle 52 is open to the atmosphere.

Thus, the dispenser valve 34 constructed as described above is normally held in its closed position by the spring 46 and the retainer 48, with the radial holes 40 closed by the valve seat 44, so that the interior storage space 12 of the container 10 is closed to the atmosphere. When the operating head 50 is finger-pressed, the stem 42 is moved to its open position against the biasing action of the spring 46, whereby the elastic valve seat 44 is elastically deformed by the stem 42, to expose the radial holes 40 to the interior storage space 12, as illustrated in FIG. 4. In this way, the storage space 12 of the container 10 is brought into communication with the ambient atmosphere, through the interior of the valve housing 36, radial holes 40 and axial passage 38 in the stem 42, and L-shaped passage 54 and nozzle 52 of the operating head 50.

The lower open end of the valve housing 36 is connected to a feed tube 56 which extends through the interior storage space 12, to a level close to the bottom of the container 10, such that the lower end of the feed tube 56 is open to the mass of the liquid 16 contained in the space 12. The feed tube 56 is formed of a relatively soft material such as polyethylene, and has a weight 58 fixedly mounted on its lower end portion so that the feed tube 56 may be elastically flexed toward the lower cylindrical wall portion of the container 10 when the container 10 is inclined, when the amount of the liquid 16 left is relatively small, for example. This allows the lower end of the feed tube 56 to be sufficiently submerged in the mass of the liquid 16 even when its residual amount is small. As is apparent from the above description, the present embodiment has a liquid delivery path through which the interior space 12 of the container 10 communicates with the outside of the container 10, for dispensing the liquid 16. The liquid delivery path consists of the interior of the valve housing 36, tube 56, radial holes 40, axial passage 38, L-shaped passage 54 and nozzle 52.

When the operating head 50 is finger-pressed to open the dispenser valve 34 after the pressure in the interior space 12 is raised by the repeated operation of the air pump or rubber bulb 32, the liquid 16 accommodated in the inerior space 12 is delivered through the nozzle 52, via the feed tube 56 and the dispenser valve 34, due to a difference between the pressure within the space 12 and the atmospheric pressure. The delivery of the liquid 16 from the nozzle 56 is stopped with the dispenser valve 34 closed by releasing a finger pressure from the operating head 50.

The feed tube 56 includes a cylindrical chamber 60 formed at a longitudinally intermediate portion thereof. The cylindrical chamber 60 has a relatively large diameter and accommodates a hollow or macaroni fiber module 62. As illustrated also in FIG. 5, the hollow fiber module 62 includes a U-shaped array of a plurality of hollow fibers 64 each having a micro-porous wall structure, and a header 66 to which the end portions of the U-shaped array consisting of the opposite open ends of the fibers 64 are bonded with a suitable adhesive such as polyurethane. The module 62 is disposed in the cylindrical chamber 60 of the feed tube 56, with the header 66 fixedly or removably supported by the wall of the chamber 60, such that the chamber 60 is divided by the header 66 into two parts.

While the opposite open ends of the micro-porous hollow fibers 64 of the module 62 are open to the part of the chamber 60 nearer to the valve housing 36, the open ends of the fibers 64 are fluid-tightly sealed with respect to the other part of the chamber 60 in which the substative portion of the U-shaped array of the fibers 64 is accommodated. Namely, the header 66 is fluid-tightly sealed with respect to the inner surface of the chamber 60, so that the liquid 16 fed into the upstream part of the chamber 60 may flow into the valve housing 36 through the wall of the hollow fibers 64 of the module 62.

The micro-porous wall structure of each of the multiple hollow fibers 64 of the module 62 has pores whose diameters are large enough to permit the liquid 16 to pass therethrough, but are small enough to inhibit the passage of bacteria in the liquid 16, thereby filtering the bacteria. Preferably, in order to remove microorganisms in the liquid 16, the diameters of the pores of the hollow fibers 64 are determined so that the micro-porous structure may remove or trap *pseudomonas diminuta* ATCC 19146. Namely, a typical micro-porous structure of the fibers 64 should prevent the passage of particles having a diameter of 0.2–0.3 μm.

When it is desired to filter virus as well as microorganisms, the micro-porous structure of the hollow fibers 64 should have smaller pores. For example, the diameters of the pores should be determined so as to prevent the passage of particles of 0.08 μm or larger, 0.07 μm or larger, and 0.025 μm or larger, for the micro-porous structure to be able to remove influenza virus, Bovinerota virus, and polio virus and/or hepatitis B virus, respectively.

The micro-porous hollow fibers 64 may be made of high polymers, preferably, such as polyolefin, polyvinyl alcohol, polysulfone, polyacrylonitrile, cellulose acetate, polymethyl methacrylate and polyamide, by a suitable known method such as micro phase separating method or drawing method.

Particularly, the micro-porous follow fibers of polyolefin by a drawing technique are preferably used according to the present invention.

In the above case, polyolefin is melt-spun at a temperature slightly lower than the ordinary spinning temperature, and at a comparatively high draft, to obtain undrawn oriented crystal hollow fibers which have a "stacked lamellae" structure. The thus obtained undrawn hollow fibers are heat-treated as needed, and then drawn at a suitable temperature, in a single layer or two or more layers. In this drawing process, the non-crystallized or incompletely crystallized portions between the lamellae are drawn, while preventing the unfolding of the lamellae, at a temperature lower than the crystalline dispersive temperature at which the molecular movement within the crystals becomes active. As a result of the drawing process, there is obtained a slit-like porous structure which has an outer shell consisting of the crystalline lamellae, and inner minute threadlike fibril elements. The prepared porous structure is thermally set, whereby the hollow fibers having micro pores are produced. The pore size of the porous structure may be controlled by the spinning, drawing and thermally setting conditions.

The thus fabricated polyolefin micro-porous hollow fibers can let much water run through the porous structure in spite of their high rejection to the particles, and have at the same time a relatively high strength. Accordingly, the hollow fibers are easily processed into a module (62) and are highly resistant to mechanical stresses during use. Such micro-porous hollow fibers are available from Mitsubishi Rayon Co., Ltd., Japan, as KPF190M (made of polypropylene), EHF390A (made of polyethylene), and EHF270H (made of polyethylene). The first two types are suitable for filtering polio virus and/or hepatitis B virus, and all of the three types are suitable for filtering bovinerota virus. For filtering microorganisms, EHF270T and EHF270W also available from Mitsubishi Rayon may be suitably used, as well as the three types indicated above. When it is desired to filter only the microorganisms, the type EHF270T is most preferable, for its high permeability to water and high capability of trapping the microorganisms. The type EHF270H exhibits a high degree of permeability, and is capable of filtering some species of virus.

When the liquid 16 is an aqueous solution, the porous hollow fibers 64 preferably have a porous structure which exhibits sufficiently high hydrophilic property. When the polyolefin porous hollow fibers having hydrophobic property are used for filtering the aqueous solution, the hollow fibers should preferably be processed to give the porous structure hydrophilic property. When the liquid 16 is an olive oil or other oily liquid, it is desirable that the porous hollow fibers 64 exhibit hydrophobic property.

In the simple liquid purifying device constructed as described above, pressing the operating head 50 will cause the liquid 16 to be fed into the chamber 60 of the feed tube 56, from the storage space 12 of the container 10 whose pressure is elevated by the air introduced by the rubber bulb 32. As a result, the liquid 16 in the chamber 60 permeates through the porous structure of the hollow fibers 64 of the module 62, whereby the microorganisms are filtered by the porous hollow fibers 64. Accordingly, the liquid 16 delivered through the nozzle 52 is sterile or free of microorganisms.

Further, the liquid delivery path or passage (including the tube 56) and the hollow fiber module 62 disposed therein are completely protected against contamination by microorganisms, by the normally closed dispenser valve 34, which is disposed near the open end of the liquid delivery path. That is, the liquid delivery path is normally closed by the dispenser valve 34, between the external open end and the hollow fiber module 62. Accordingly, the liquid delivery path, hollow fiber module 62 and the liquid 16 are effectively protected against contamination by microorganisms while the instant device is not in use.

Furthermore, the instant liquid purifying device is protected against contamination by microorganisms even while the dispenser valve 34 is in the open position. More specifically, the liquid 16 is forced to flow through the open dispenser valve 34, always in the direction toward the external open end of the liquid delivery path (toward the nozzle 52), due to the higher pressure in the interior storage space 12 than the external atmospheric pressure Even in the open position of the dispenser valve 34, there may arise no flow of the liquid 16 in the reverse direction toward the interior space 12 of the container 10, whereby the entry of external microorganisms into the liquid delivery path, and the entry through the open dispenser valve 34 into the feed tube 56 may be effectively avoided or minimized.

Thus, the instant liquid purifying device is capable of filtering microorganisms by means of the porous hollow fibers 64, while effectively protecting the liquid 16 in the delivery path against contamination by microorganisms. Namely, the device maintains a highly stable purifying function for a relatively long period of time.

In the liquid purifying device of the type described above, the permeation of the liquid 16 through the micro-porous structure of the hollow fibers 64 occurs due to the comparatively high pressure within the container. Consequently, the efficiency of filtering of the liquid 16 (that is, the rate of flow of the liquid per unit area of the fibers 64) by the hollow fibers 64 may be held at a relatively high level. Accordingly, the hollow fiber module 62, and the liquid purifying device as a whole, may be made relatively compact and small-sized. This is an additional advantage of the present device.

Moreover, since the rubber bulb 32 as the compressed-gas supply means for pressurizing the interior space 12 is provided outside the container 10, the container may be readily re-charged with the liquid 16, by simply removing the cap 20.

In the instant embodiment, the ambient atmosphere (air) is used as a gas for pressurizing the interior storage space 12 of the cotnainer 10. Thus, the instant liquid purifying device does not cause an environmental pullution (air pollution) as encountered where a special compressed gas such as a compressed flon gas is used.

In the instant embodiment, the push-operated type dispenser valve 34 as used for a spray can or bomb charged with a pressurized fluid is used as the second valve means for dispensing the purified liquid 16 by finger-pressing the operating head 50. Therefore, the purification and dispensation of the liquid 16 may be easily and efficiently effected by a single hand.

In the instant purifying device, the hollow fiber module 62 disposed in the liquid delivery path for filtering microorganisms contained in the liquid 16 has a relatively large filtering surface area, since the module 62 consists of an array of the multiple hollow fibers 64. Accordingly, the instant device permits a sufficiently large amount of the liquid 16 purified per unit time, i.e., a sufficiently high rate of delivery of the purified liquid 16, even when the liquid 16 is a comparatively viscous liquid such as an olive oil. This favorably results in reducing the size of the device, and provides improvements in ease of handling or manipulation of the device.

Figure 6:
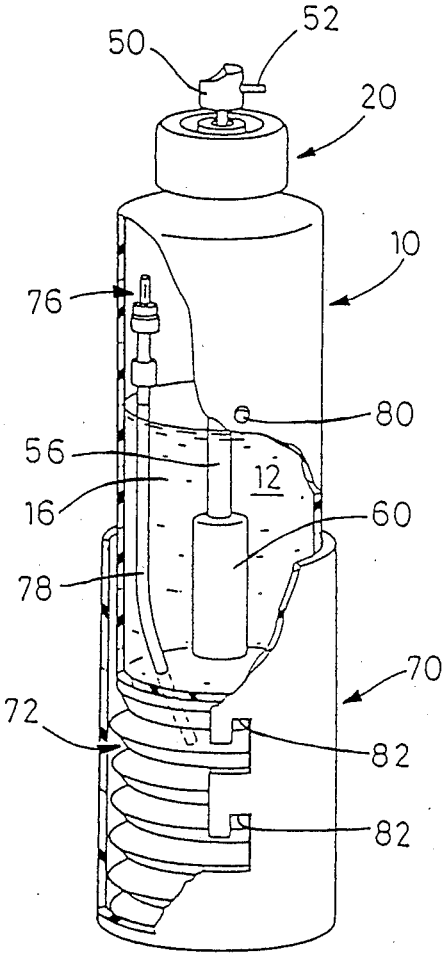
FIG. 6 is a partly cut-away perspective view of another embodiment of the liquid purifying device of the invention.

Referring next to FIG. 6, another embodiment of the liquid purifying device will be described. This embodiment uses a modified form of the compressed-gas supply means for pressuring the interior storage space 12 of the container. In the interest of brevity and simplification, the same reference numerals as used with respect to the preceding embodiment will be used in FIG. 6, to identify the functionally corresponding elements, and redundant description of these elements will not be provided.

In the instant modified embodiment, the lower portion of the container 10 is inserted or put within a cylindrical casing 70 which is closed at its bottom end. Between the bottom walls of the casing 70 and the container 10, there is disposed a bellows type air pump 72 which is formed of an elastic material such as a soft resin material. The air pump 72 is secured at its opposite ends to the opposite bottom walls of the casing 70 and container 10. The interior of the bellows of the air pump 70 communicataes with the external space (ambient atmosphere) through a check valve (not shown), and with the interior space 12 of the container 10 through a feed tube 78 extending into the space 10, and a suction check valve (first valve means) 76.

The air pump 72 sucks in the ambient air through the appropriate check valve and compresses the sucked air, when the bellows is alternately contracted and expanded by reciprocatingly moving the container 10 relative to the casing 70. Thus, the compressed air is forced into the interior space 12 through the feed tube 78 and the suction check valve 76.

Figure 7:
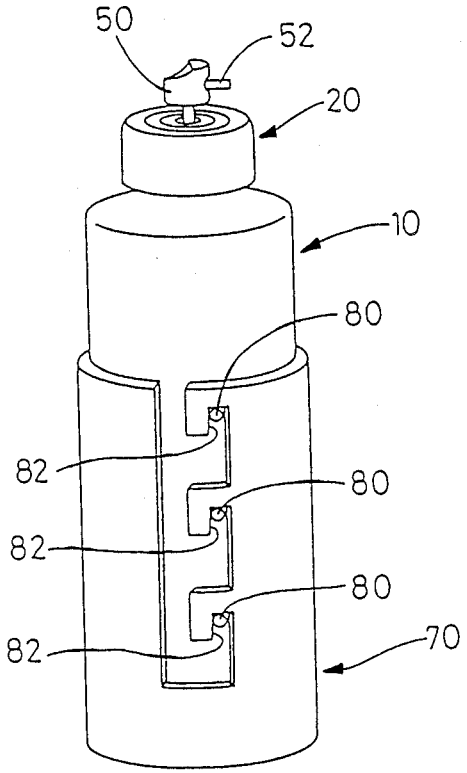
FIG. 7 is a perspective view indicating a condition in which a liquid container is received in a casing.

Referring further to FIG. 7, reference numerals 80 designate tabs which are formed on the outer circumferential surface of the container 10. The tabs 80 are normally held in engagement with corresponding cutouts 82 formed through the cylindrical wall of the casing 70, so that the container 10 is held in its rest position under the elastic biasing force of the elastic bellows of the air pump 72 which acts in the upward direction.

In the thus constructed instant embodiment, too, the operation of the head 50 will cause the liquid 16 in the interior space 12 to be purified by the hollow fiber module 62 and delivered out of the container 10, due to the pressure in the interior space 12 which is raised by the alternate contraction and expansion of the bellows of the air pump 72. Therefore, the present modified embodiment provides basically the same advantages as the preceding embodiment.

Figure 8:
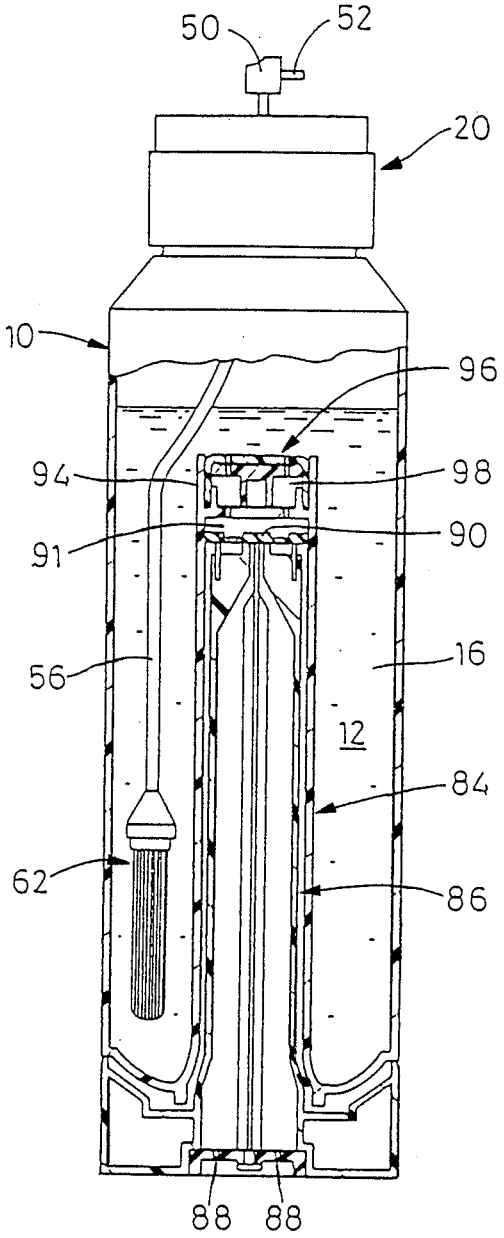
FIG. 8 is a schematic elevational view in longitudinal cross section of a further embodiment of the liquid purifying device of the invention.

Reference is now made to FIG. 8 which shows a further embodiment of the liquid purifying device, which uses compressed-gas supply means different from those of the preceding first and second embodiments. In the instant embodiment, too, the same reference numerals as used in the preceding embodiments will be used to identify the corresponding elements, and redundant description thereof will not be provided.

Figure 9:
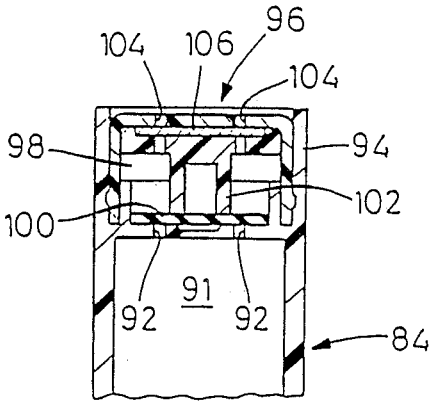
FIG. 9 is an enlarged fragmentary elevational view in cross section illustrating an upper end portion of a cylinder which constitutes a part of compressed-air supply means used in the embodiment of FIG. 8.

In the present liquid purifying device, the container 10 is formed with an air cylinder 84 projecting from the bottom wall, in coaxial relation with the cylindrical wall of the container 10. The cylinder 84 receives a piston 86 such that the piston 86 is reciprocable within the cylinder 84. A cylinder chamber 91 is defined between the upper ends of the cylinder 84 and piston 86, and air inlets 88 are formed through the bottom wall of the container 10. With the piston 86 reciprocated within the cylinder 84, the ambient air is sucked into the interior of the piston 86 through the air inlets 88, and introduced into the cylinder chamber 91. The compressed air is discharged out of the cylinder chamber 91, through discharge ports 92 formed through the upper end wall of the cylinder 84, as shown in FIG. 9. The construction of the compressed-air supply means using the air cylinder 84 and piston 86 is described in detail in laid-open Publication No. 60-28529 of examined Japanese Utility Model Application (published in 1985). No further description of the construction in this specification is deemed necessary to understand the principle of the present invention.

Figure 10:
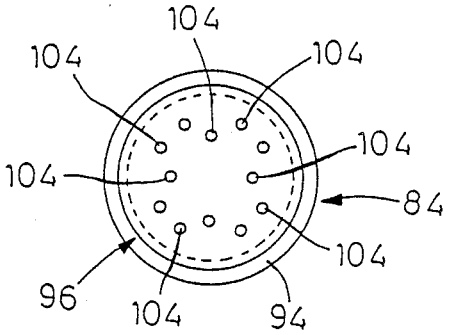
FIG. 10 is a plan view of the upper end portion of the cylinder of FIG. 9.

The air cylinder 84 which forms part of the compressed-air supply means is provided with a cylindrical support 94. As indicated in FIGS. 9 and 10, the cylindrical support 94 is formed integrally with the upper end wall of the cylinder 84 through which the discharge ports 92 are formed. The cylindrical support 94 fluid-tightly accommodates a plug 96 which has a cylindrical leg 102. The plug 96 cooperates with the upper end wall of the cylinder 84 to define an annular space 98 to which the discharge ports 92 are open.

The cylindrical support 94 further accommodates a thin rubber disc 100 which is forced at a central portion thereof by the leg 102 of the plug 96 against the upper end wall of the air cylinder 84, such that the discharge ports 92 are normally closed by the rubber disc 100. Thus, the discharge ports 92, plug 96 and rubber disc 100 cooperate to constitute a suction check valve as first valve means which permits a flow of the air from the cylinder chamber 91 into the annular space 98, but inhibits a flow of the air into the cylinder chamber 91.

The plug 96 has a plurality of communication holes 104 formed therethrough for communication between the annular space 98 and the interior storage space 12 of the container 10. The plug 96 has a porous membrane 106 embedded therein such that each communication hole 104 is divided into two parts by the porous film 106. The porous film 106 has a hydrophobic property and functions as a filter for filtering microorganisms. More specifically, the porous film 106 is a porous film formed of a hydrophobic fluorine-contained resin such as tetrafluoroethylene (commercially known as "Teflon", for example). The porous structure has pores which permit the air to flow therethrough but do not permit microorganisms in the air to pass therethrough. Preferably, the porous film 106 have pore diameters of approximately 0.45 m or smaller, so that the porous structure may filter bacteria which adhere to minute particles usually contained in the air.

The instant liquid purifying device provides basically the same significant advantages as the preceding embodiments. In addition, the ambient air introduced into the cylinder chamber 91 by the reciprocation of the piston 86 is filtered or purified by the porous film 106, and is fed as sterile air into the interior storage space 12. Therefore, the air in the storage space 12 is kept free of microorganisms. Thus, the instant arrangement provides an additional advantage of effectively preventing proliferation of microorganisms.

Experimental clinical tests were conducted to confirm the liquid purifying capability of the instant purifying device shown in FIGS. 8–10, i.e., the ability of protecting the liquid 16 against infection by microorganisms which may be introduced into the container 10, through the liquid delivery path. The results of the experiments and tests will be described.

Figure 11:
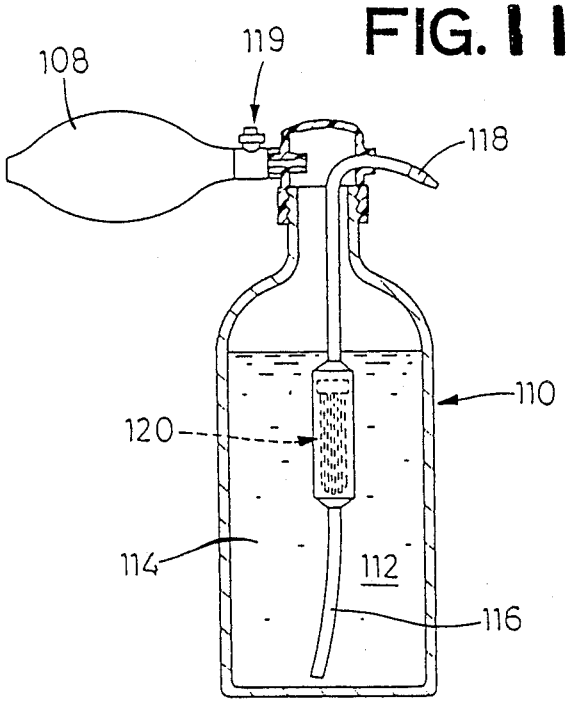
FIGS. 11, 12 and 13 are elevational views in longitudinal cross section of known liquid purifying devices used as comparative examples compared with the device according to the present invention, in evaluating the liquid purifying capability.
Figure 12:
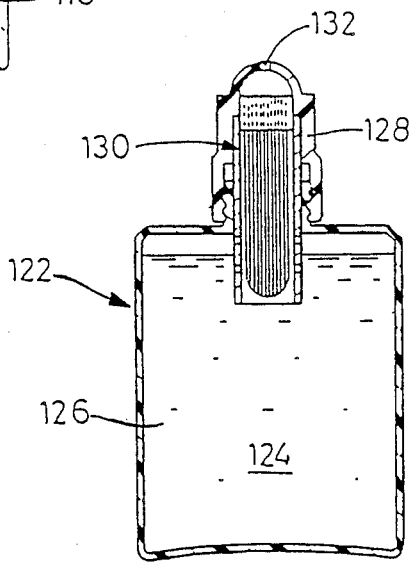

To clarify the advantageous aspects of the instant liquid purifying device according to the invention, conventional devices as shown in FIGS. 11 and 12 were prepared as comparative examples, and were subjected to the same experiments.

The liquid purifying device of FIG. 11 used as Comparative Example 1 does not have the second valve means for selectively opening and closing the liquid delivery path or passage. In operation, the pressure within an interior storage space 112 of a container 110 is raised by alternate contraction and expansion of a rubber bulb 108, whereby a liquid 114 in the storage space 112 is fed through a feed tube 116 and purified by a hollow fiber module 120 (similar to the module 62) provided in the feed tube 116, so that the filtered liquid 114 is delivered through a nozzle 118. The delivery of the purified liquid 114 from the container 110 is terminated by releasing the pressure in the storage space 112, by opening a valve 119 connected in a passage between the rubber bulb 108 and the container 110.

The liquid purifying device of FIG. 12 used as Comparative Example 2 has neither supply means for supplying a compressed or liquefied gas into the container, nor the first and the second valve means as provided according to the present invention. The device uses an elastic container 122 formed of polyethylene, which is elastically contracted with pressure applied by hand and which is restored to its original shape when the hand pressure is released. The pressure in the container 122 is raised by contracting the container body, whereby a liquid 126 contained in the container 122 is forced into a mouth portion 128 in which is disposed a hollow fiber module 130 similar to the module 62. As a result, the liquid 126 is purified by the module 130, and is then delivered through an outlet 132.

The containers 10, 110 and 122 used for the instant device and Comparative Examples 1 and 2 have a same volume of 150 ml, and the hollow fiber modules 62, 120 and 130 used in these devices employ porous hollow fibers (64) of polyethylene (EHF270T available from Mitsubishi Rayon Co., Ltd., Japan, indicated above), to which are applied propylene glycol monostearate, to give the fibers a hydrophilic property. An experiment on the purifying device of Comparative Example 1 revealed a slight amount of flow of the liquid 114 from the nozzle 118 back into the feed tube 116 when the delivery of the liquid 114 was stopped by opening the valve 119. Further, an experiment on the purifying device of Comparative Example 2 revealed a flow of the liquid 126 and the air from the outlet 132 back into the mouth portion 128 and into the hollow fiber module 130 when the container 122 contracted to deliver the liquid was expanded to revert to its original shape.

In the liquid purification experiments on the instant device and the devices of Comparative Examples 1 and 2, the container 10, 110, 122 was sterilized in a clean bench with sodium hypochlorite solution (1000 ppm), and was then rinsed repeatedly by sterilized distilled water until the detected concentration of chloride was reduced to zero, that is, until the interior of the container was devoid of residual chloride. Then, 150 ml of soybean-casein digest medium was poured into the container 10, 110, 122. In the meantime, the feed tubes 56, 116, hollow fiber modules 62, 120, 130 and other components were sterilized by ethylene oxide gas before attachment to the container 10, 110, 122.

The devices were removed from the clean bench, and the solution (soybean-casein digest medium) was delivered or dispensed ten times, each in an amount of 1 ml, from each container. The devices were then kept at 25° C. After 24 hours, the solution was dispensed in an amount of 10 ml from each container, into a sterilized test tube. The specimens were subjected to a sterility test, and the number of live bacteria was measured by mixed plating method, according to Pharmacopoeia of Japan, 11th Edition. Then, the above steps were repeated each day. Namely, the solution was dispensed ten times from each container, each in an amount of 1 ml, and the devices were kept at 25° C. The containers were re-charged with the medium, when it was insufficient.

In each of the liquid purifying devices of FIGS. 8–10 of the invention and Comparative Examples 1 and 2, the soybean-casein digest medium (solution) in the containers must be purified by the respective hollow fiber modules 62, 120, 130 when the medium was dispensed, and therefore the medium which passed through the modules must be free of microorganisms. Therefore, the degree of contamination of the medium by the microorganisms which entered through the outlets 52, 118, 132 of the containers can be determined by observing the medium which was delivered through the outlets.

TABLE 1

| | Invention | Comparative Examples 1 | 2 | 3 |
|---|---|---|---|---|
| 1st Day | | | | |
| Sterility | – | – | – | – |
| Live Bacteria* | 0 | 0 | 0 | 0 |
| 7th Day | | | | |
| Sterility | – | + | + | – |
| Live Bacteria* | 0 | $3 \times 10^4$ | $2 \times 10^4$ | 0 |
| 14th Day | | | | |
| Sterility | – | + | + | + |
| Live Bacteria* | 0 | $3 \times 10^6$ | $6 \times 10^6$ | 2 |
| 21st Day | | | | |
| Sterility | – | + | + | + |
| Live Bacteria* | 0 | $4 \times 10^7$ | $5 \times 10^8$ | $3 \times 10^4$ |

*Number of bacteria contained per 1 ml

Figure 13:
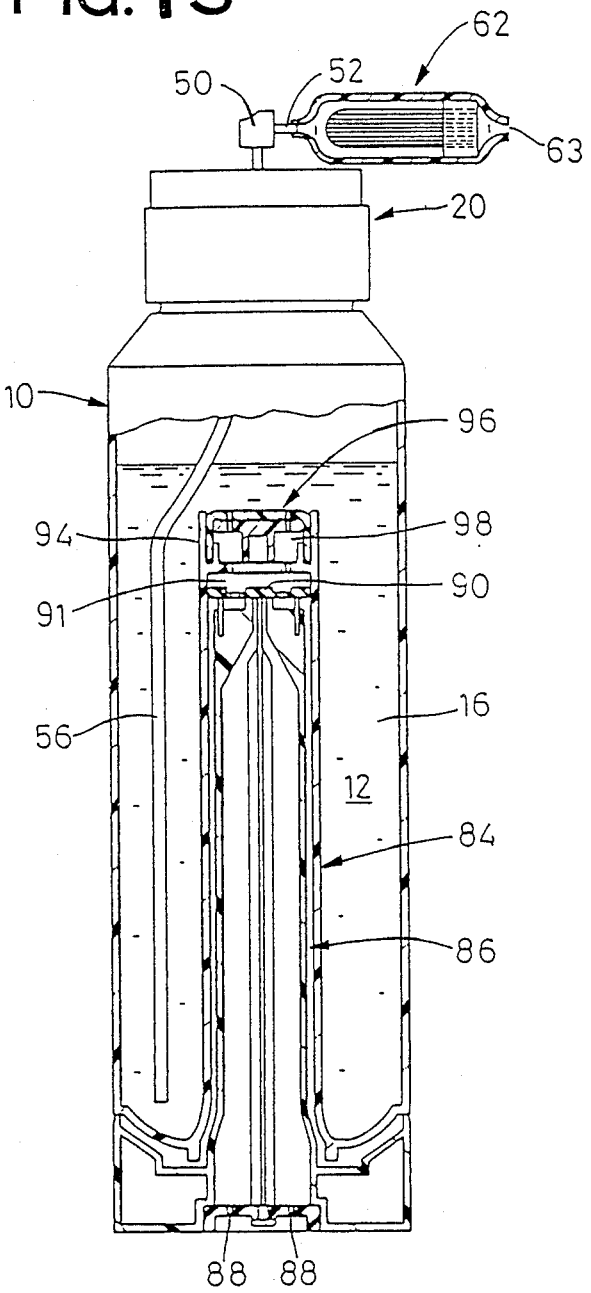

The same experiments as described above were conducted on Comparative Example 3 which was constructed as shown in FIG. 13. Table 1 indicates the results of the experiments and tests, which include those of Comparative Example 3. In the device of Comparative Example 3, the hollow fiber module 62 as shown in FIG. 8 was disposed in series connection with the nozzle 52 of the second valve means (dispenser valve) As is apparent from Table 1, it was found that the medium (solution) in the container 10 of Comparative Example 3 of FIG. 13 was seriously contaminated by the microorganisms which entered through an outlet 63 of the hollow fiber module 62, which was disposed outside the container, in connection with the second valve means.

In the clinical tests, three specimens of each of the devices of the invention (FIGS. 8–10) and Comparative Examples 1 and 2 as used in the above experiments were used. The devices were sterilized in the same manner as in the above experiments, and the containers were charged with a solution (soft contact lens soaking solution) which was prepared by dissolving granules for a soaking solution for soft contact lenses, in distilled water.

The purifying devices were clinically used in a clinic, for dispensing the soaking solution, when necessary (about twenty times per day, each in an amount of 7 ml), for cleaning the contact lenses removed from the lens wearers who visited the clinic during the test period. The containers were re-charged with the soaking solution, as needed.

The number of live bacteria in the solution delivered from the container of each purifying device was counted according to the mixed plating method, two times, i.e., one month and two months after the beginning of the clinical tests. The results of the tests are indicated in Table 2.

From the results of the experiments and clinical tests indicated in Tables 1 and 2, it will be understood that the liquid purifying device of FIGS. 8–10 according to the present invention is capable of effectively preventing contamination by microorganisms through the liquid delivery path or passage exposed to the atmosphere, and stably provides excellent liquid purifying capability.

TABLE 2

| | | Number of Live Bacteria* One Month After | Two Month After |
|---|---|---|---|
| INVENTION | (1) | 0 | 2 |
| | (2) | 0 | 0 |
| | (3) | 3 | 1 |
| Comparative Example 1 | (1) | $3 \times 10^2$ | $2 \times 10^3$ |
| | (2) | $4 \times 10$ | $6 \times 10^2$ |
| | (3) | $6 \times 10^2$ | $4 \times 10^4$ |
| Comparative Example 2 | (1) | $5 \times 10^2$ | $3 \times 10^5$ |
| | (2) | $8 \times 10^3$ | $2 \times 10^2$ |
| | (3) | $2 \times 10^3$ | $8 \times 10^4$ |

*Number of bacteria contained per 1 ml

The present invention has been described in its preferred embodiments wherein the ambient air is used as a pressurized fluid to raise the pressure within the container of the liquid purifying device, such that the pressurized fluid is fed into the container by suitable supply means such as the rubber bulb air pump or air cylinder, which is permanently attached to or incorporated in the structure of the container. However, the liquid purifying device according to the present invention may employ separate external compressed-air supply means which is not permanently attached to or incorporated in the container, but which is connectable to the suction check valve of the container, as in the following embodiments. In these embodiments, the same reference numerals as used in the preceding embodiments will be used to identify the corresponding components, redundant description of which will not be provided.

Figure 14:
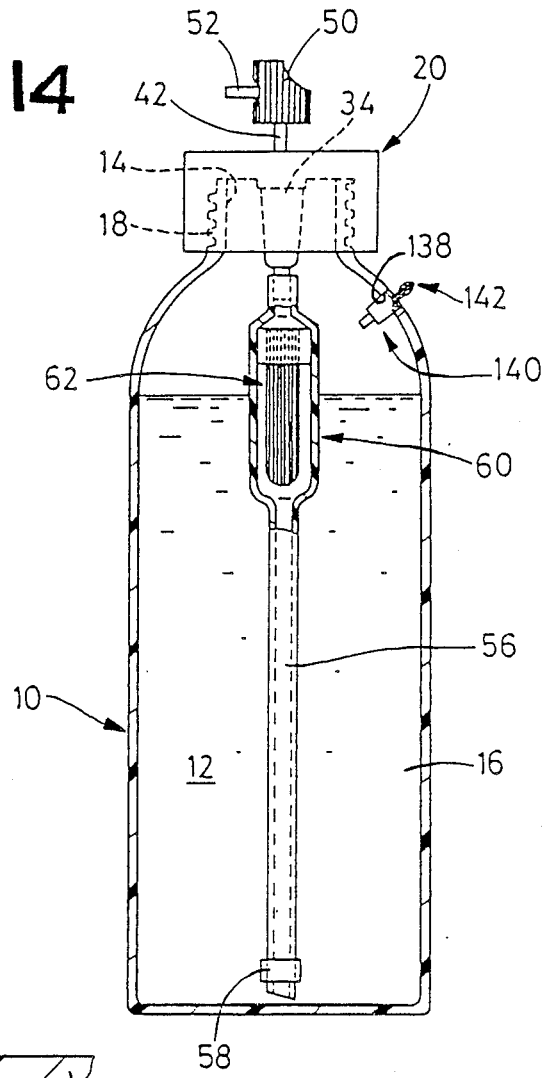
FIGS. 14, 16 and 17 are schematic elevational views in longitudinal cross section of further embodiments of the invention, which are constructed to be connected to a separate compressed-gas supply means.
Figure 15:
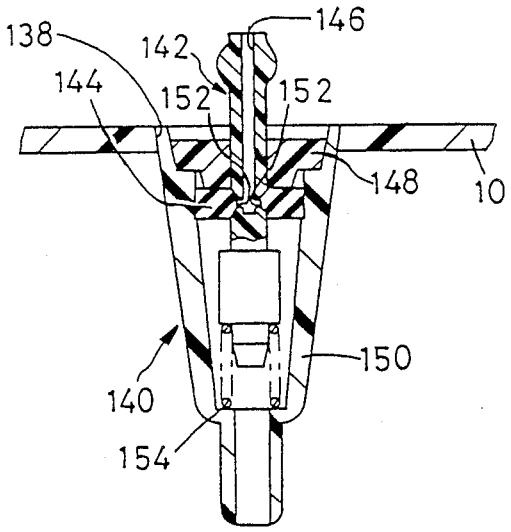

In the embodiment shown in FIG. 14, the container 10 has a gas inlet 138 communicating with the ambient atmosphere. A suction check valve 140 as the first valve means is fitted in the gas inlet 138. As illustrated in FIG. 15, the check valve 140 is a known type of check valve for a compressed air, which includes a valve housing 150 open to the interior storage space 12 of the container 10. The valve housing 150 accommodates a valve stem 142 which has an axial passage 146 formed therethrough in fluid communication with the ambient atmosphere, and radial holes 152 communicating with the axial passage 146. The housing 150 is provided with an elastic valve seat 144 and a retainer 148 which are fixed thereto such that the stem 142 is normally placed in its closed position under a biasing action of biasing means in the form of a coil spring 154. In this position, the radial holes 152 are closed by the valve seat 144, with the valve seat pressed against the retainer 148 by the spring 154 via the valve stem 142. The stem 142 is slidably movable over a predetermined distance between its closed and open positions. The thus constructed suction check valve 140 fitted in the gas inlet 138 permits a flow of a pressurized gas into the interior space 12 of the container 10, but inhibits a flow of the gas and the stored liquid 16 out of the interior space 12.

Figure 16:
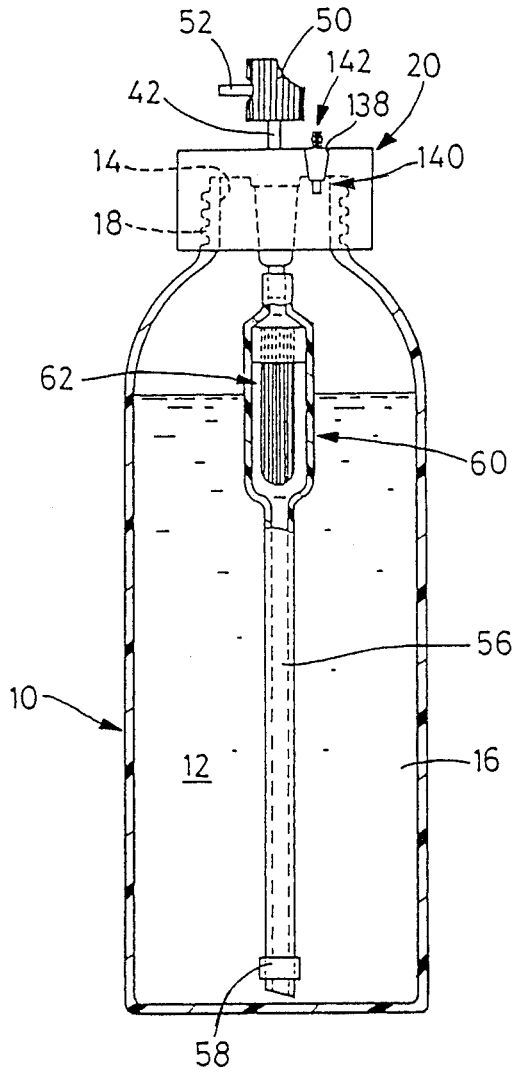
Figure 17:
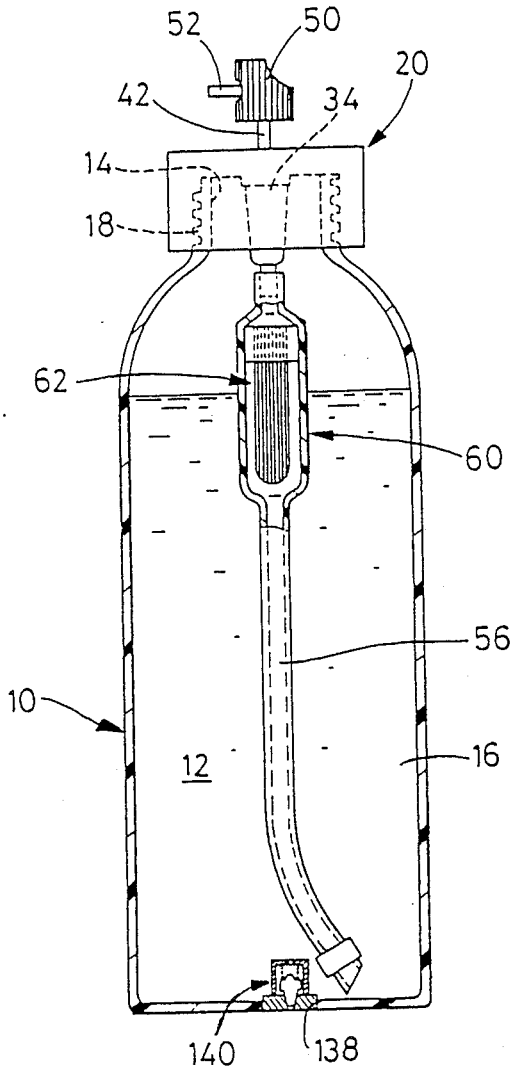

The gas inlet 138 and the suction check valve 140 may be provided in the cap 20 threaded to the bottleneck 18, as in a further embodiment of the invention shown in FIG. 16, or alternatively in the bottom wall of the container 10, as in a still further embodiment of the invention shown in FIG. 17.

Figure 18:
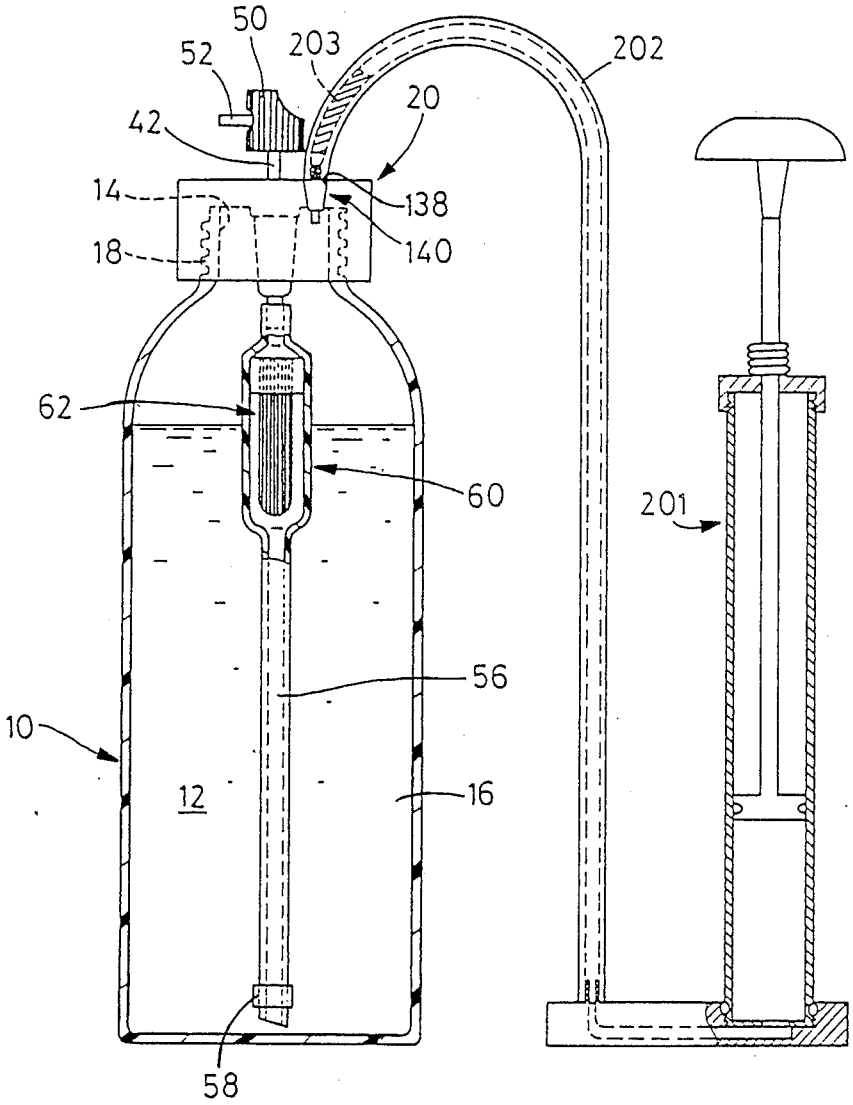
FIGS. 18 and 19 are views depicting external compressed-gas supply means connected to the liquid purifying devices of FIGS. 16 and 17, respectively.

FIG. 18 illustrates the container 10 of FIG. 16, which is supplied with compressed air, by a hand-operated reciprocating air pump 201. This air pump 201 is connected to the suction check valve 140 fitted in the gas inlet 138 formed in the cap 20, so that the air compressed by the air pump 201 is fed into the interior space 12 of the container 10. Reference numeral 203 denotes a micro-porous hollow fiber module made of polypropylene for filtering microorganisms contained in the compressed air, so that the compressed air fed into the space 12 is free of microorganisms.

Figure 19:
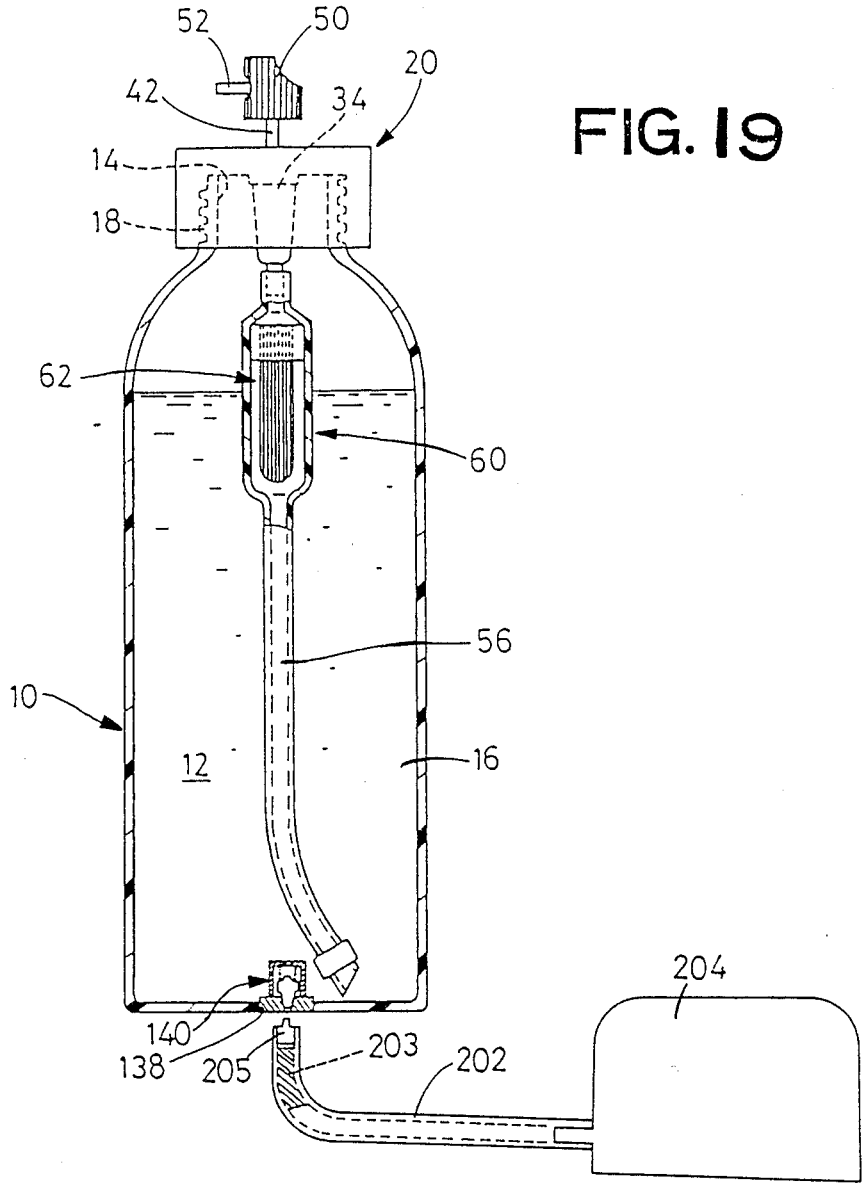

FIG. 19 illustrates the container of FIG. 17, which is supplied with compressed air, by an air compressor 204 connected by the pipe 202 to the suction check valve 140 fitted in the gas inlet 138 formed in the bottom wall of the container 10. The micro-porous hollow fiber module 203 similar to that used in the embodiment of FIG. 17 has an open end 205 exposed at the free end of the pipe 202. With the open end 205 connected to the suction check valve 140 so as to push open the valve, the compressed air produced by the compresser 204 is fed into the interior space 12 of the container 10, after the air is filtered by the micro-porous hollow fiber module 203.

For permitting autoclaving to sterilize the container, micro-porous hollow fiber module and other components in the container of the liquid purifying device, these components are made of heat-resistant materials. Namely, after the container is charged with the liquid 16 and closed by the cap 20, the interior of the container is sterilized by an autoclaving treatment. The sterile pressurized air is then fed into the interior space 12, in the manner described above, so that the liquid 16 is kept free of microorganisms. Further, the liquid 16 is filtered by the micro-porous hollow fiber module when the liquid 16 is dispensed through the outlet 52. In addition, the liquid 16 is protected against contamination by external microoraganisms, during delivery through the outlet 52. Thus, the liquid purifying system is extremely reliable in its function of protecting the liquid 16 against contamination by microorganisms.

In an alternative method of sterilization, the container 10 charged with the liquid 16 and closed by a cap other than the cap 20 is autoclaved for sterilization, and the sterilized micro-porous hollow fiber module and the sterilized cap 20 are set on the container. Then, the container is supplied with sterile compressed air. This method is suitable where the liquid 16 is a pharmaceutical liquid for medical applications, which requires a particularly high degree of sterility.

Where the liquid 16 is a pharmaceutical liquid which cannot be sterilized by autoclaving, the sterilized container is charged with the sterilely prepared pharmaceutical liquid, and with sterile compressed air. In this case, too, the purifying system is extremely sterile.

When the instant liquid purifying device is used for purposes other than medical applications, the interior space 12 must not necessarily be sterile, since the liquid 16 is filtered before it is dispensed, and is protected against contamination by external microorgainsms during dispensation of the liquid from the outlet of the container, as described above.

There will be described some embodiments which are adapted to use as a pressurized fluid, liquefied gases, or compressed gases other than air. In these embodiments, too, the same reference numerals as used in the preceding embodiments will be used to identify the corresponding components, redundant description of which will not be provided.

Figure 20:
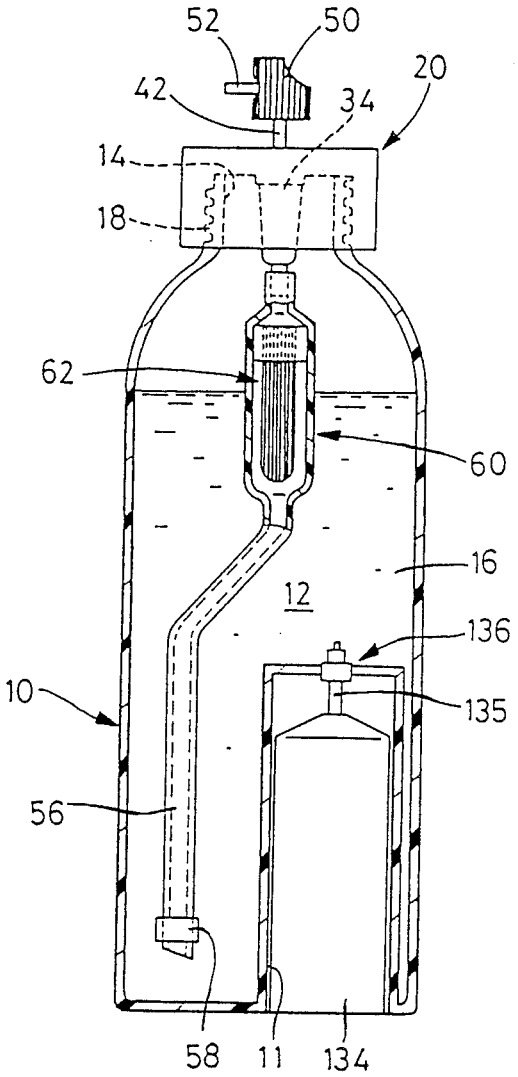
FIG. 20 is a schematic elevational view in longitudinal cross section of a still further embodiment of the present invention.

In the liquid purifying device according to the embodiment of FIG. 20, the container 10 has a recess 11 which is open in the bottom wall. The recess 11 has a size suitable for accommodating therein a bomb 134 which is charged with a liquefied gas. The bomb 134 has a nozzle 135 connected to a check valve (first valve means) 136 provided in the top wall of the recess 11 which is remote from the open end at the bottom wall of the container 10. The bomb 134 can communicate with the interior space 12 of the container 10, through the check valve 136. When the bomb 134 is pushed at its bottom wall, a valve (not shown) incoporated in the bomb 134 is opened, so that the gas in the bomb 134 is fed into the interior space 12 through the nozzle 135 and the check valve 136, whereby the pressure in the interior space 12 is raised.

In this liquid purifying device, the liquid 16 stored in the interior space 12 pressurized by pushing the bomb 134 at its bottom wall is delivered while being filtered by the micro-porous hollow fiber module 62, when the operating head 50 is pressed. Thus, the instant device provides basically the same advantage as the preceding embodiments.

While a pressurized fluid such as a compressed or liquefied gas may be supplied from an air pump or bomb disposed or received within the container, as described above, the pressurized fluid may be supplied from a pressure source outside the container. The device shown in FIG. 14 is an example adapted to be connectable to such an external pressure source.

The device of FIG. 14 uses a bomb 160 charged with a compressed or liquefied gas. The bomb 160 is of a known type such as a gas-lighter bomb or spray can with a suitable valve. To supply the gas into the interior space 12 of the container 10, the bomb 160 is connected to the check valve 140, as indicated in FIG. 21.

Described more specifically, the check valve 140 is normally placed in its closed position of FIG. 15 by the coil spring 154, wherein the radial holes 152 are closed by the elastic valve seat 144 so that the interior space 12 is enclosed. When the bomb 160 is connected at its filler stem 162 to the stem 142 of the check valve 140, so as to push the stem 142 against the biasing force of the spring 154, the elastic valve seat 144 is elastically deformed, whereby the radial holes 152 are exposed to the interior of the valve housing 150. As a result, the interior space 12 is brought into communication with the bomb 160, through the valve housing 150, radial holes 152 and passage 146. With a comparatively high pressure within the bomb 160, the compressed or liquefied gas in the bomb 160 is forced into the interior space 12, whereby the pressure in the space 12 is raised.

The compressed gas used as a pressurized fluid may consist of at least one gas selected from the group which includes air, helium, argon, nitrogen, oxygen and carbon dioxide, and the liquefied gas may consist of at least one gas selected from the group which includes chlorofluorinated hydrocarbon, chlorinated hydrocarbon, and hydrocarbon (e.g., propane, isobutane, normal butane). It is desirable, however, to use a compressed or liquefied gas which does not change the properties of the liquid 16 stored in the container 10. Air is particularly preferred because of its easy handling, low cost and harmlessness.

The bomb 160 for accommodating such compressed or liquefied gases may be a tin can, a stainless can, an aluminum can, a melamine container, a polyester container or a polycarbonate container.

The suction check valve 140 may be replaced by a simpler valve 156 as shown in FIG. 22. This valve 156 has a construction similar to that of the suction check valve 24 used in the embodiment of FIG. 2. The check valve 156 is fitted in the gas inlet 138 formed in the shoulder portion of the container 10, capable of inhibiting flows of the liquid 16 and the compressed gas from the interior space 12 of the container 10. The container 10 and the check valve 156 cooperate with each other to define an annular groove 158 adapted to accommodate the end portion of the stem 162 of the bomb 160. In operation, the bomb 160 is connected to the check valve 156, with the stem 162 fitted in the annular groove 158, so that the compressed or liquefied gas is fed into the interior space 12, through the slit 30 of the valve 156.

In the embodiments of FIGS. 1, 6, 8, 14, 16, 17 and 20; the interior storage space 12 of the container 10 is pressurized by a high-pressure compressed or liquefied gas, such that the container serves as a pressure accumulator, contrary to the container of the type in which the interior pressure is raised by elastically contracting the container body per se. Accordingly, the filtration of the liquid by the micro-porous structure (micro-porous hollow fibers) can be effected at a higher pressure, and therefore at a higher efficiency (with a comparatively increased amount of passage of the liquid per unit area of the micro-porous structure).

While the present invention has been described in detail in its presently preferred embodiments, for illustrative purpose only, it is to be understood that the invention is not limited to the details of the illustrated embodiments.

In the illustrated liquid purifying devices, the pressurized-gas supply means takes the form of a rubber bulb air pump, a bellows type air pump, a reciprocating type air cylinder, a bomb of a gas spray type, etc.. However, the container 10 may be adapted for connection with any other suitable sources of compressed or liquefied gas, through suitable supply conduit and valve means.

The rubber bulb 32, suction check valve 24, 140, and other components may be provided on the cap 20, rather than on the body of the container 10. It will be obvious that the pressurized-gas supply means such as the rubber bulb 32 and the bellows type air pump 72 may be adapted to be removably connected to the container 10.

It will also be understood that the first valve means is not limited to those used in the illustrated embodiments, but may be provided by various other known valves, such as a duckbill type having a cylindrical elastic valving member with a slit bottom wall, an umbrella type having an umbrella-shaped valving member, and a ball type having a spherical valving body which closes a valve hole with a biasing force of a spring or other biasing member.

Further, the second valve means for dispensing the liquid from the container 10 is not limited to those used in the illustrated embodiments, but may be otherwise constructed, provided the second valve means is capable of opening and closing the liquid delivery path or passage. For example, the second valve means may be provided by a valve for a spray bomb, as disclosed in laid-open Publication No. 59-24865 of examined Japanese Patent Application. Further, a ball valve, a needle valve, or a cock valve may be used as the second valve means.

While the micro-porous hollow fibers are used in the illustrated embodiments as a micro-porous membrane disposed in the liquid delivery path, for removing bacteria and virus from a flow of the liquid dispensed from the container, other filters such as a planar micro-porous membrane may be used. Further, the location of the micro-porous filter may be suitably selected along the liquid delivery path, provided that the filter is located upstream of the second valve means in the direction of flow of the liquid when the liquid is delivered from the container.

While the porous film 106 is used in the embodiment of FIGS. 8–10 as a filter disposed in the air supply passage between the pressurized-gas supply means and the interior space 12, for filtering the compressed air or gas or liquefied gas, other types of air filter such as hollow fibers may be used. It is also possible to use paper filters (HEPA filter, for example) which are capable of removing 99.97% or more of particles having a diameter of 0.3 $\mu$m.

It will also be understood that the invention may be embodied with various other changes, modifications and improvements, which may occur to those skilled in the art, without departing from the spirit of the invention defined in the appended claims.

As described above, the liquid purifying device constructed according to the present invention is capable of dispensing sterile water, pharmaceutical liquid or other liquids used in the fields of medical treatment, health and hygienics, biochemistry and bacteriology, and in the fields associated with foods and drinks and cosmetics. In particular, the instant liquid purifying device is suitable in the fields of medical treatment, and health and hygienics, and more specifically, for dispensing solutions or liquids that are used for: preparing and/or storing a sterile disinfecting solution; preparing a drug; cleaning medical goods or facilities or instruments; cleaning the interior of a living body; diagnosing a living body by effecting a flow of the liquid through the body; cleaning hands of people engaged in medical diagnosis and remedy; and cleaning or wiping wounds, operated parts of a body, bedsores, artificial anus, artificial vocal cord, and skins around these parts of a body. A typical specific application of the instant liquid purifying device is to dispense solutions for soaking, cleaning or storing contact lenses.

What is claimed is:

1. A liquid purifying device for dispensing a liquid, comprising:

a container having an enclosed interior space in which a mass of said liquid is stored;

first valve means, attached to said container, for permitting a supply flow of a pressurized gas therethrough into said interior space of the container to raise a pressure within said interior space, and for inhibiting a discharge flow of said pressurized gas and said liquid therethrough out of said interior space;

a liquid delivery path having one end submerged in said mass of the liquid and extending through said container such that the other end is disposed outside said interior space, said liquid being delivered out of said interior space through said liquid delivery path, due to the pressure within said interior space which is raised by said pressurized fluid;

second valve means, disposed in said liquid delivery path, for selectively closing and opening the liquid delivery path to prevent contamination by microorganisms of liquid which has been purified but not yet delivered; and means for filtering said liquid to remove microorganisms from the liquid delivered through said other end of said liquid delivery path consisting essentially of a micro-porous membrane disposed in a portion of said liquid delivery path which is upstream of said second valve means, as viewed in a direction in which said liquid is delivered out of said interior space, said micro-porous membrane filtering said liquid to remove microorganisms from the liquid delivered through said other end of said liquid delivery path.

2. A liquid purifying device according to claim 1, further comprising pressurized-gas supply means for supplying one of a compressed gas and a liquefied gas, as said pressurized gas, into said interior space of the container through said first valve means.

3. A liquid purifying device according to claim 2, wherein said pressurized-gas supply means is located outside said container.

4. A liquid purifying device according to claim 2, wherein said container has means for defining said interior space, and means for defining a space for accommodating said pressurized-gas supply means.

5. A liquid purifying device according to claim 2, further comprising an air filter disposed in a passage between said pressurized-gas supply means and said interior space of the container, for filtering said pressurized gas to remove microorganisms from said pressurized gas which is supplied into said interior space.

6. A liquid purifying device according to claim 1, wherein said second valve means includes a valve stem, a valve seat and biasing means for normally holding said valve stem in a closed position, said valve stem having a passage which constitutes a part of said liquid delivery path, said passage being closed by said valve seat when said valve stem is placed in said closed position, said valve stem being axially movable against a biasing action of said biasing means, from said closed position to an open position in which said passage is open to permit said liquid to be delivered through said liquid delivery path.

7. A liquid purifying device according to claim 1, wherein said pressurized gas consists essentially of ambient air.

8. A liquid purifying device according to claim 1, wherein said micro-porous membrane comprises an array of micro-porous hollow fibers, each of which has a micro-porous wall structure having a pore size determined so as to permit passage of said liquid therethrough but inhibit passage of the microorganisms therethrough.

9. A liquid purifying device according to claim 8, wherein said micro-porous hollow fibers are made of polyolefin.

10. A liquid purifying device according to claim 8, wherein said liquid delivery path includes a chamber in which said array of micro-porous hollow fibers is accommodated, said chamber having a header secured thereto so as to divide said chamber into two parts, said array of micro-porous hollow fibers being U-shaped such that the U-shaped micro-porous hollow fibers are held at opposite end portions thereof by said header such that the remaining portions of said micro-porous hollow fibers are disposed in one of said two parts which is nearer to said one end of said liquid delivery path.

11. A liquid purifying device according to claim 1, wherein said container has a bottleneck having an opening, and a shoulder portion near said bottleneck, said first valve means being attached to a shoulder portion of said container.

12. A liquid purifying device according to claim 1, further comprising a cap, and wherein said container has a bottleneck having an opening closed by said cap, said liquid delivery path extending through said cap.

13. A liquid purifying device according to claim 12, wherein said first valve means is attached to said cap.

14. A liquid purifying device according to claim 1, wherein said container has a bottom wall to which said first valve means is attached.

15. A device for dispensing a liquid used for contact lenses, comprising:

a container having an enclosed interior space in which a mass of said liquid is stored;

pressurized-gas supply means for supplying a pressurized gas, into said interior space of the container;

first valve means, attached to said container, for permitting a supply flow of said pressurized gas therethrough into said interior space of the container to raise a pressure within said interior space, and for inhibiting a discharge flow of said pressurized gas and said liquid therethrough out of said interior space;

a liquid delivery path having one end submerged in said mass of the liquid and extending through said container such that the other end is disposed outside said interior space, said liquid being delivered out of said interior space through said liquid delivery path, due to the pressure within said interior space which is raised by said pressurized fluid;

second valve means, disposed in said liquid delivery path, for selectively closing and opening the liquid delivery path to prevent contamination by microorganisms of liquid which has been purified but not yet delivered; and means for filtering said liquid to remove microorganisms from the liquid delivered through said other end of said liquid delivery path consisting essentially of an array of micro-porous hollow fibers disposed in a portion of said liquid delivery path which is upstream of said second valve means as viewed in a direction in which said liquid is delivered out of said interior space, said array of micro-porous hollow fibers filtering said liquid to remove micro-organisms from the liquid delivered through said other end of said liquid delivery path.

16. A device for dispensing a liquid used for contact lenses according to claim 15, wherein said micro-porous hollow fibers have pore diameters which are small enough to remove the microorganisms including bacteria and/or virus, from the liquid.

* * * * *